United States Patent [19]

Austin

[11] Patent Number: 4,561,227

[45] Date of Patent: Dec. 31, 1985

[54] PATIO ENCLOSURE

[75] Inventor: Barry G. Austin, Marshall, Mich.

[73] Assignee: General Aluminum Products, Inc., Charlotte, Mich.

[21] Appl. No.: 601,044

[22] Filed: Apr. 16, 1984

[51] Int. Cl.[4] ..... E04B 1/12

[52] U.S. Cl. ..... 52/226; 52/641; 52/691; 135/106

[58] Field of Search ..... 52/226, 83, 63, 691, 52/90, 71, 225, 642, 641, 646; 135/106, 89, 101, 102; 403/205, 403, 172, 176

[56] References Cited

U.S. PATENT DOCUMENTS

| | | | |
|---|---|---|---|
| 2,813,310 | 11/1957 | Harrison | 52/226 |
| 2,883,712 | 4/1959 | Shelamer | 52/63 |
| 3,952,463 | 4/1976 | Lane | 135/106 X |

FOREIGN PATENT DOCUMENTS

| | | | |
|---|---|---|---|
| 625501 | 8/1961 | Canada | 52/63 |
| 1485754 | 9/1977 | United Kingdom | 52/63 |

*Primary Examiner*—Carl D. Friedman
*Assistant Examiner*—Naoko N. Slack
*Attorney, Agent, or Firm*—Price, Heneveld, Huizenga & Cooper

[57] ABSTRACT

A patio enclosure adapted for affixation to the exterior wall of an existing structure consisting of a plurality of side and front panels, a roof support structure and an overlying fabric roof. The roof support structure includes a series of rafters having centrally depending therefrom a cable receiving slotted finger. A cable extends between the rafter assembly from its point of affixation to the existing structure to its point of affixation to the front panels of the enclosure. The cable passes through the slot in the depending finger.

6 Claims, 9 Drawing Figures

PATIO ENCLOSURE

BACKGROUND OF THE INVENTION

This invention relates to a patio enclosure and, more specifically, to a durable yet lightweight enclosure which can be assembled and disassembled with relative ease. The patio enclosure which is the subject of this invention is particularly suited for attachment to an existing structure, the exterior wall of such structure forming one wall of the enclosure when assembly has been completed.

Patio structures of the general type here under consideration previously have been proposed. Some, such as the structure disclosed in U.S. Pat. No. 2,808,065, issued to Ellis, entitled AWNING SUPPORT, on Oct. 1, 1957, are primarily designed to be utilized as an awning and include a frame composed of pipe-like members. Construction such as that shown in Ellis requires relatively heavy frame members to withstand normal wind, water, etc., forces. The Ellis structure will not, in other words, support heavy rain and/or wind loads unless the frame members are extremely heavy duty. Structures such as shown in Ellis, moreover, do not lend themselves readily to the inclusion of walls, a door and the like as does the structure of the present invention.

A lightweight patio cover frame is disclosed in U.S. Pat. No. 3,052,290, issued to Orloff, entitled PATIO COVER, on Sept. 4, 1962. Orloff employs two swingable arms which swing outwardly from an exterior wall of a house, and a flexible, accordion-like panel is slidable along the swingable arms when the arms are swung perpendicular to the building. The flexible panel has a plurality of ribs which extend between the swingable arms, adding some structural rigidity to the cover. It does not appear, however, that the Orloff structure would be durable when exposed to even moderate winds. Furthermore, the Orloff structure is not sloped to permit rain run-off, and if it were so sloped, would be even more susceptible to the forces of the wind and rain.

It has been proposed, heretofore, to build free-standing, self-contained patio enclosures. See, e.g., U.S. Pat. No. 3,333,373, issued to Taylor et al., entitled PORTABLE FOLDING CAMPING CABIN OR HOUSE, on Aug. 1, 1967. While structures of the type shown in this patent have met with marked commercial success, they have not been adaptable to joining to an existing structure.

SUMMARY OF THE INVENTION

The patio enclosure which is the subject of the present invention is adapted to be secured adjacent an exterior wall of an existing structure. It comprises a plurality of front panels and side panels, the panels being hingedly secured, one to another, and erectable to form the sidewalls and front wall of the enclosure. A plurality of rafter assemblies extend in downwardly sloped fashion from the exterior wall to the top of the front wall, each of the rafter assemblies including upper and lower rafter sections having centrally depending therefrom a cable receiving finger, the finger having at least one stabilizing cable receiving slot therein. First means are provided for connecting upper rafter sections to the exterior wall and second means for connecting the lower rafter sections to the top of the front wall. A stabilizing cable interconnects between the first and second connecting means and passes through the slot in the cable receiving finger, the length of the stabilizing cable being such that in its secured condition the rafter assembly of which it is a part is generally straight. A flexible roof overlies the rafter assemblies and means are provided for securing the roof in this overlying position.

DESCRIPTION OF THE PREFERRED EMBODIMENT

Figure 1:
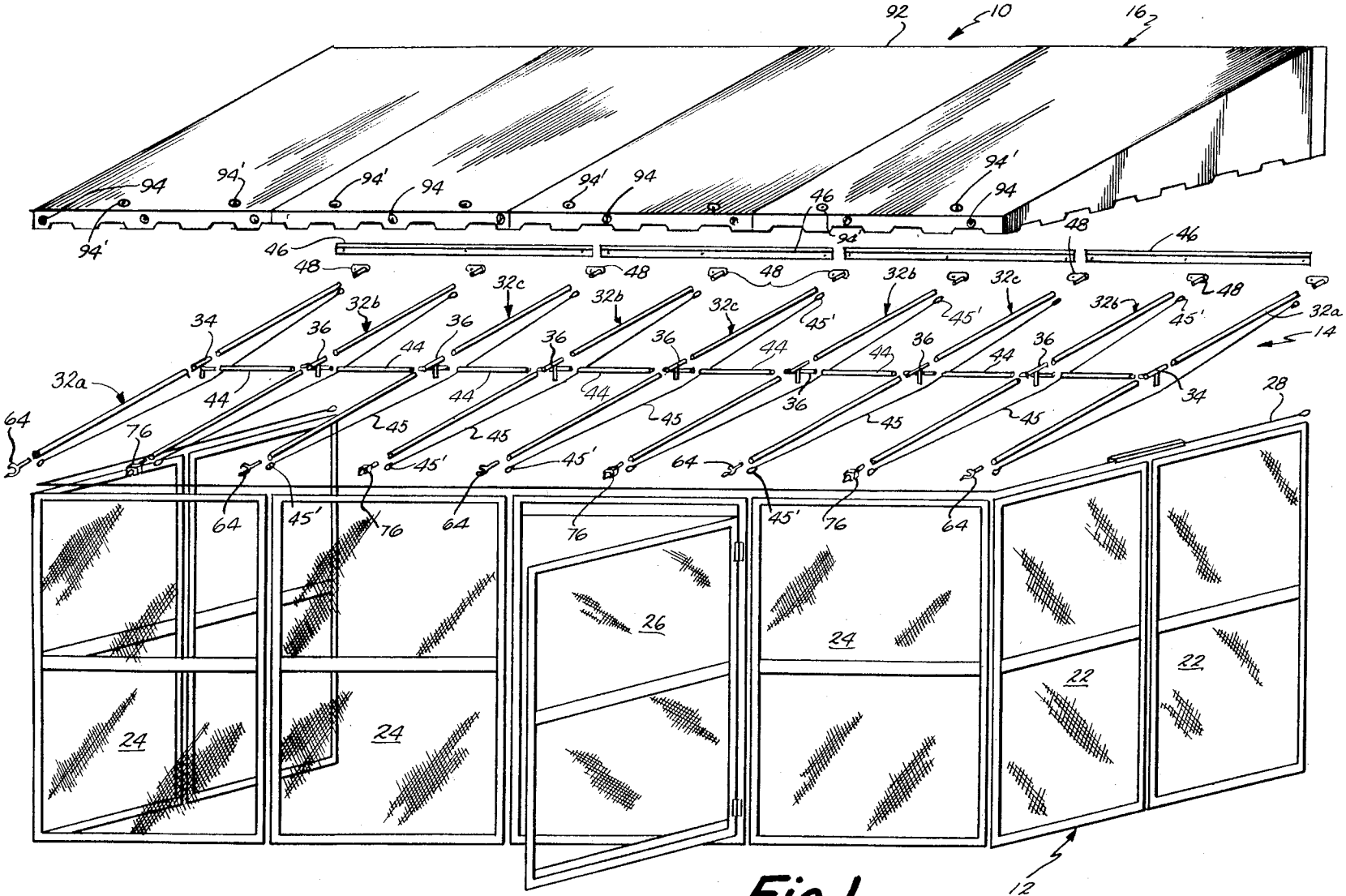
FIG. 1 is an exploded, perspective view of the patio enclosure which is the subject of this invention.

The patio enclosure 10 which is the subject of this invention is especially adapted to be affixed to the wall 11 of an existing structure. Wall 11, typically, will contain sliding doors or the like opening to the interior of a house, enclosure 10, thus, being accessible from within the house.

Enclosure 10 includes a panel assembly designated generally by the reference numeral 12 and a flexible roof support assembly designated generally by the reference numeral 14. A flexible roof 16 overlies and is affixed to the enclosure when installation has been completed, as will be described in detail hereinafter.

Panel assembly 12 includes side panels 22 and front panels 24, 26. The panel frames, preferably, are fabricated from extruded or roll-formed metal, suitably keyed at the corners, and flexibly intereconnected in accordion fashion by flexible hinges, all in the manner illustrated in detail in U.S. Pat. No. 3,333,373, issued Aug. 1, 1967, to Taylor et al., this patent being specifically incorporated by reference herein. Panel 26 incorporates a door, latch, etc., as shown in this patent. The panels generally will be screened to provide a bug-free enclosure while permitting the passage of fresh air therethrough.

A peripheral cable 28 of the aircraft type is nested within the upper surfaces of the panels and retained in position in a manner such as shown in U.S. Pat. No. 3,335,535, issued Aug. 15, 1967, to Lane, or Application Ser. No. 155,466, filed June 2, 1980, by Trumley. The former patent illustrates panels formed by an extrusion process suitable for use in the practice of the instant invention. The latter application illustrates panels fabricated by a roll-forming process suitable for use in the practice of the present invention. Both of these disclosures are incorporated by reference as though fully set forth herein. Cable 28 is anchored at each end of panel assembly 12.

Flexible roof support assembly 14 includes three types of rafter assemblies, although the same, for the most part, are made up from interchangeable parts. At either extremity of the patio enclosure is positioned a rafter assembly 32*a* which includes a three-fingered hub 34 and a cable engaging tube tip 64, as will be described hereinafter. Those rafter assemblies 32*b* which have their outer extremities resting near the top center of each of the front panels 24 and door panel 26 include a four-fingered hub 36 and a panel saddle tube tip 76. Those rafter assemblies 32*c* which have their outer extremities positioned between the adjacent panels 24 and 26 interconnected with peripheral cable 28 include a four-fingered hub 36 and a cable engaging tube tip 64.

Figure 4:
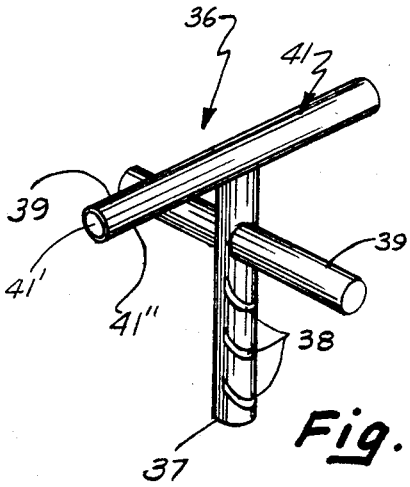
FIG. 4 is a perspective view of the four-fingered hub.

The four-fingered hub 36 is illustrated in FIG. 4. It includes a slotted depending finger 37 having upwardly directed slots 38 therein at spaced intervals. Extending from either side thereof are lateral tube receiving fingers 39. Rafter tube receiving fingers 41 extend from the four-fingered hub 36 at opposite sides thereof displaced 90° from the fingers 39 and elevated with respect thereto. Three-fingered hubs 34 are similarly formed excepting for the deletion of one lateral tube receiving finger 39. Fingers 39 and 41 are rounded at their extremities to facilitate telescopic mating with lateral tubes 44 and rafter tubes 42 and 43.

Hubs 34 and 36, in accordance with the preferred embodiment of this invention, are injection molded from du Pont Super Tuff nylon. Rafter tube receiving fingers 41 include a two-inch section 41' of cold-rolled steel which is press fitted into a receiving sleeve 41'' formed during the molding process. Lateral tube receiving fingers 39 need not be so reinforced.

Figure 2:
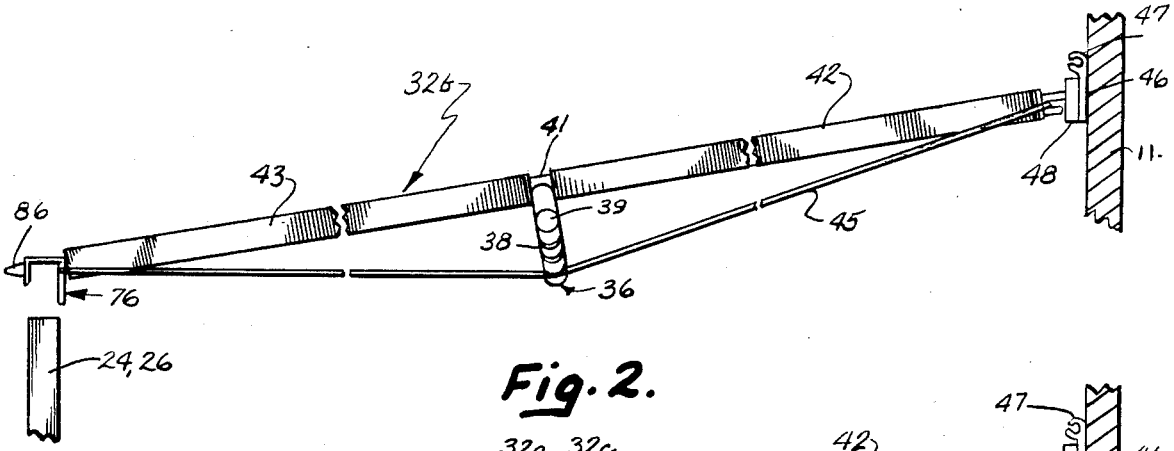
FIG. 2 is a fragmentary, side elevation showing one type of rafter assembly which is utilized to support the flexible roof.
Figure 3:
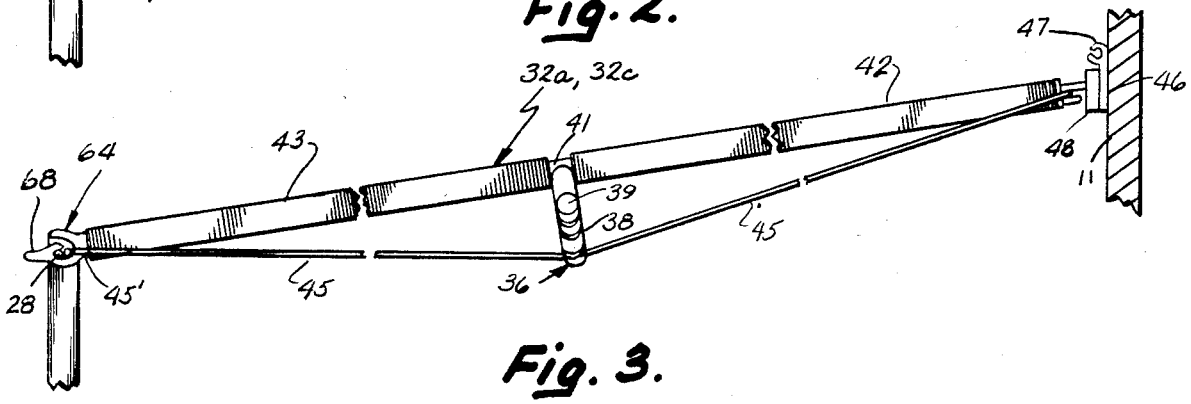
FIG. 3 is a fragmentary, side elevation showing another type of rafter assembly which is utilized to support the roof.

With additional reference to FIGS. 2 and 3, lower rafter tube 43 telescopically interconnects with one of the fingers 41 on hub 36. Upper rafter tube 42 likewise telescopically interconnects with the opposing finger 41. Stabilizing tubes 44 connect, in similar fashion, between adjacently facing fingers 39 to prevent rolling of the rafters. Tubes 42, 43 and 44, in accordance with the preferred embodiment of this invention, are of extruded aluminum and have an inside diameter slightly greater than the outside diameter of fingers 41 and 39.

A C-channel 46, which may be segmented for facilitating shipment, is affixed to the exterior surface of the existing wall 11, as shown generally in FIG. 1. C-channel 46 has a C-shaped groove 47 which runs continuously along the top thereof. The purpose of groove 47 is to receive and retain a welting running along the rear edge of flexible roof assembly 16.

Figure 5:
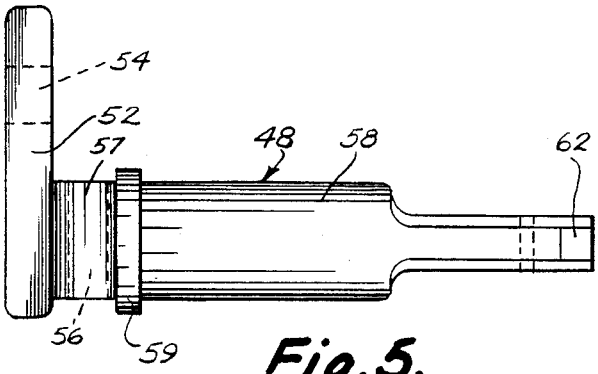
FIG. 5 is a plan view of the hanger tube tip.

Overlying C-channel 46 are a series of hanger tube tips 48. Tips 48, as shown in detail in FIGS. 5 and 6, each include a channel abutting member 52 adapted to overlie C-channel 46. A screw is passed through aperture 54 in tip 48, through C-channel 46 and into the existing wall 11. Tip 48 includes an undercut horizontal cable retaining slot 56 formed adjacent channel abutting member 52 accessible through converging passageway 55*a*. It also includes a tube receiving extremity 58 having a detent 62 and a shoulder 59 against which the upper rafter tubes 42 may abut. Member 52 and tube receiving extremity 58 are interconnected by a flexible webbing 57, the function of which will become clear hereafter.

Tube receiving extremity 58 of tip 48 is fabricated, preferably, in accordance with the teachings of U.S. Pat. No. 3,952,463, issued Apr. 27, 1976, to Lane. This is also true of the cable engaging tube tip 64 and the panel saddle tube tip 76 to be discussed hereinafter. Each of the tips 48, 64 and 76 are, in accordance with the preferred embodiment of this invention, injection molded from a suitable plastic such as Delrin, Zytel or du Pont Super Tuff.

Figure 7:
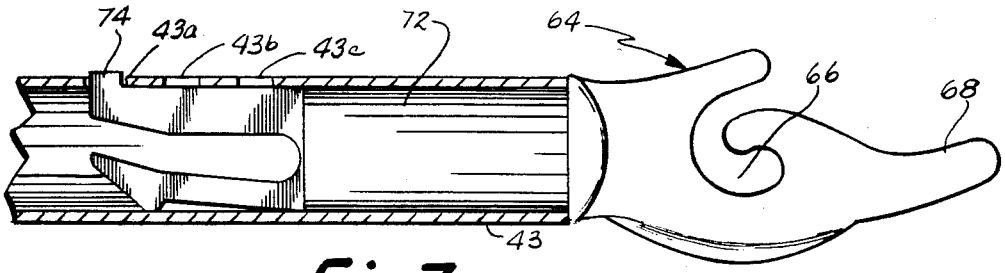
FIG. 7 is a side elevation view of a cable engaging tube tip showing, in section, a lower rafter section telescopically fitted thereover.

Cable engaging tube tip 64, shown in FIG. 7, is identical to the structure disclosed in the aforenoted U.S. Pat. No. 3,952,463. It includes a cable retaining slot 66 which is adapted to receive both the peripheral cable 28 and a loop 45' on the end of each of the tension cables 45. Extending from the extremity thereof is a grommet receiving tip 68 which functions, along with similar tips 86 on saddle tip 76, to retain the forward section of the roof in position. Tube tip 64, like tube tip 48, includes a tubular shank 72 having a resilient detent 74 formed integrally therewith in accordance with the teachings of the aforenoted patent.

Figure 9:
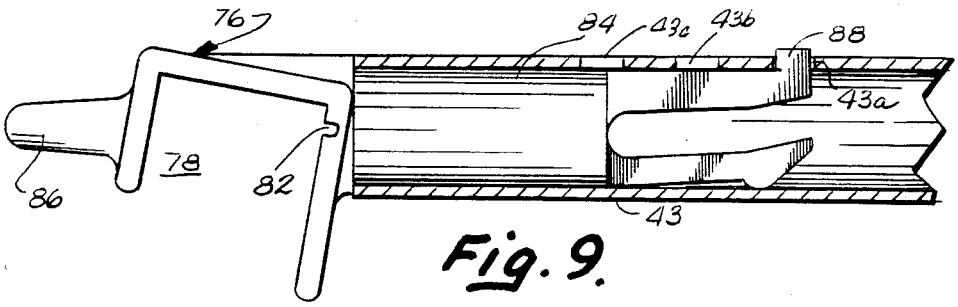
FIG. 9 is a side elevation of the saddle tube tip assembly showing, in section, a lower rafter member telescopically fitted thereover.
Figure 8:
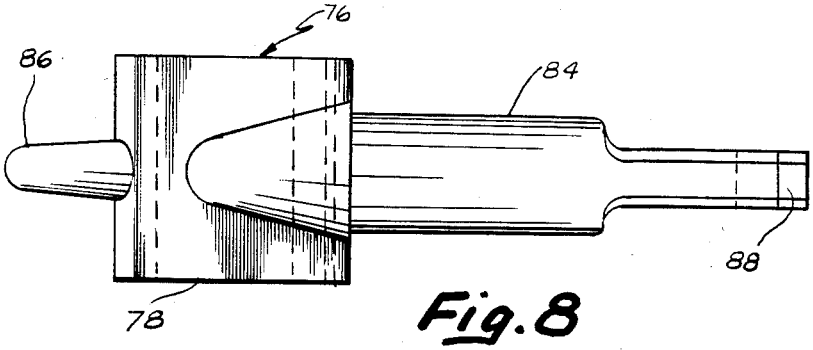
FIG. 8 is a plan view of the saddle tube tip assembly.

The panel saddle tube tip 76 is shown in FIGS. 8 and 9. It includes a generally U-shaped panel receiving saddle 78 sized so as to nest snugly over panels 24, 26 as shown in FIG. 2. Saddle 78 incorporates along the inner forward surface thereof a cable retaining slot 82. Tip 76 is also provided with a tubular shank 84 and depressible detent 88. Grommet receiving tip 86, formed integrally therewith, functions to retain flexible roof 16 in position.

Enclosure 10 is shipped preferably from the factory with the side panels 22, front panels 24 and door panel 26 and the peripheral cable 28 preassembled. The flexible interconnections permit the panels to be folded in accordion fashion for suitable packing. Reference is made to the aforenoted Taylor and Lane patents and Trumley application, which illustrate this construction and foldability in detail. Once the panel assembly 12 has been removed from the shipping carton, it is expanded and folded into a generally rectangular configuration, such as shown in FIG. 1, at the situs of installation. The rear side panels 22 are then affixed to the existing wall 11 in plumb and correctly spaced fashion by any suitable means such as L-shaped brackets (not shown). The panel assembly 12 is then squared and the side and front panels secured to the supporting surface by similar brackets.

The next step in the assembly of the patio enclosure which is the subject of this invention is attachment of the C-channel 46 and the hanger tube tips 48 to the exterior of the wall 11 of the existing structure. This attachment, as shown in FIGS. 1–3, is elevated with respect to the upper surfaces of panels 24, 26 so that the roof assembly, when installed, will be sloped downwardly toward the front of the enclosure to permit proper drainage. It is essential, of course, that the position of the hanger tube tips 48 be such that truss assemblies 32*a*, 32*b* and 32*c*, when installed, will lie generally parallel to one another, and that truss assemblies 32*a* and 32*c* will meet front panels 24 and door panel 26 at the flexible interconnections therebetween so that peripheral retaining cable 28 will be available for engagement by the cable engaging tube tips 64. The hanger tube tips 48 for the truss assemblies 32*b* should be positioned midway between those for the truss assemblies 32*a* and 32*c*. Proper installation is facilitated by predrilling C-channel 46 during fabrication of the enclosure components.

The rafter assemblies 32*a*, 32*b* and 32*c* are next assembled. Each of the tubes 42 and 43 is provided with a series of three detent receiving apertures 42*a*, 42*b*, 42*c* and 43*a*, 43*b*, 43*c*, respectively, at locations spaced lengthwise near one extremity thereof. The purpose of these apertures is as set forth in the aforenoted U.S. Pat. No. 3,952,463—i.e., to provide adjustability to the rafter length to accommodate minor size variations of the flexible roof 16. Adjustment will be made, as a practical matter, only at tips 64 and 76, upper tubes 42 remaining in the position shown in FIG. 6, ordinarily, throughout the life of the enclosure. Use of identical tubes 42 and 43, nevertheless, reduces inventory and packing problems.

Once the rafter assemblies, less tension cables 45, are completed, they are interconnected to the hanger tube tips 48 in the pattern shown in FIG. 1, the forward extremities of the rafters being permitted to merely rest upon the upper surfaces of the front panels 24 and door panel 26 for the moment. The premeasured tension cables 45, which have a loop 45' at either end thereof, are next installed, one extremity of each cable being looped through either the cable retaining slot 66 in the cable engaging tube tip 64 or the cable retaining slot 82 in the panel saddle tube tip 76.

Figure 6:
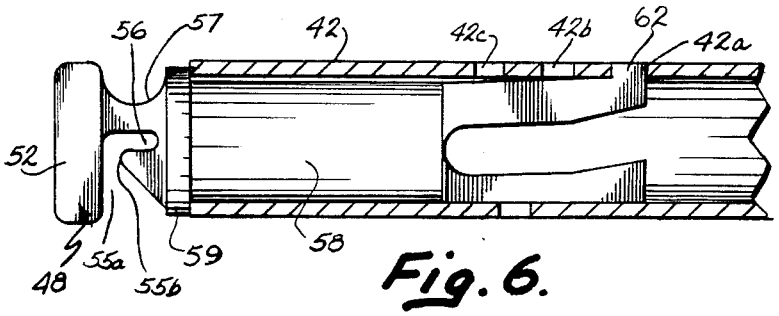
FIG. 6 is a side elevation view of the hanger tube tip showing, in section, an upper rafter member telescopically fitted thereover.

The weight of the rafter assemblies, with specific reference to FIG. 6, has caused the flexible hanger tube tips 48 to bend downwardly at webbing 57, closing off the passageway into slot 56. Each rafter assembly is now raised to bring it into generally perpendicular position with respect to existing wall 11 opening the passageway into slot 56. Once such raising has been accomplished, the opposite looped end of each of the tensioning cables is placed into the slot 56 and the rafter assembly lowered until its forward extremity again rests upon the front walls of the enclosure. This effectively traps the extremities of the tension cables proximate existing wall 11 into slots 56. The tensioning cables may, if necessary, be placed in one of the slots 38 in depending finger 37 during the foregoing procedure to keep the cables properly tensioned and avoid any tendency for the ends distal from the existing wall 11 to slide free from the panel saddle tube tips 76.

Each of the truss assemblies 32*a* and 32*c* is then bowed slightly upwardly and the peripheral cable 28 passed into the cable retaining slot 66 of the cable engaging tube tip 64 (see FIG. 3). Thereafter the panel saddle tube tips 76 are snapped over and resiliently engage the center of each of the front panels 24 and the door panel 26. They are preferably fastened in this position by a screw passed downwardly through a predrilled hole into the panel frame. The stabilizing tubes are then installed by telescoping them onto facing receiving fingers 39 on the hubs 34 and 36. Stabilizing tubes 44 are displaced below the plane of rafter tubes 42 and 43, due to the aforenoted construction of hubs 34 and 36, preventing damming of the roof at these locations.

Each of the rafter assemblies 32*a*, 32*b* and 32*c* is next straightened. This is accomplished by lifting the hub 34, 36 associated with each assembly while simultaneously pulling down on the center of the tensioning cable 45. When the rafter is stressed to a straightened configuration, tension cable 45 is hooked into the nearest slot 38 in the hubs 34 and 36. The provision of multiple slots 38 on the depending fingers 37 of the three- and four-fingered hubs, 34 and 36, respectively, thus, permits compensation for minor tolerance variations, installation variations and rafter length adjustment.

Flexible roof assembly 14 includes a welting 92 running along the rear edge thereof. This welting, as an initial step in installing the roof, is threaded into the C-shaped groove 47 in C-channel 46 commencing on one side of the enclosure and progressing to the other. The roof is then spread evenly over the rafter assembly and the corner grommets 94 therein passed over the tips 68 of the cable engaging tube tip 64 forming a part of rafter assemblies 32*a*. The remaining grommets 94 are thereafter forced over and into engagement with the tips 86 and 68 on the rafter assemblies 32*b* and 32*c*, respectively.

Roof 14, preferably, includes a series of drain grommets 94' having an inner diameter of approximately 3/16-inch. These grommets permit drainage of unusual quantities of water in severe storms. They are positioned approximately five inches back from the eave and spaced midway between the rafter assemblies.

The gables and rear edges of the roof are secured to the adjacent structure using Velcro or a similar fastener. Velcro may also be utilized to attach the underside of the roof to the rafter assemblies at desired locations to prevent flapping in the wind. A U-shaped channel 96 may be positioned over the hinged juncture between side panels 22, if desired, to insure the same remain aligned. The enclosure is then ready for use.

Wind forces tending to pull the roof upwardly away from the enclosure are borne primarily by peripheral cable 28 through cable engaging tube tips 64. Downward forces such as those resulting from rain are borne by the rafter assemblies, tension cables 45 functioning to hold them straight despite the presence of forces which would otherwise cause them to bow downwardly. Stabilizing tubes 44 prevent rafter rotation as these loads are experienced.

The resultant enclosure is extremely wind resistant and the roof will retain a uniform slope despite heavy rain. These goals are accomplished through utilization of parts which are both lightweight and inexpensive, permitting assembly and disassembly of the structure, for storage, with minimal effort. The result is an extremely useable patio enclosure in return for the investment of a moderate amount of money.

While a preferred embodiment of this invention has been described in detail, it will be readily apparent to those skilled in the art that other embodiments may be conceived and fabricated without departing from the spirit of this invention. Such other embodiments are to be deemed as included within the scope of the appended claims unless these claims, by their language, expressly state otherwise.

The embodiments of the invention in which an exclusive property or privilege is claimed are defined as follows:

1. A patio enclosure adapted to be secured adjacent an exterior wall of an existing structure, said enclosure comprising:

a plurality of front panels and side panels, said panels being hingedly secured, one to another, and erectable, to form the sidewalls and front wall of said enclosure;

a plurality of rafter assemblies each extending in downwardly sloped fashion from said exterior wall to the top of the front wall, each of said rafter assemblies including upper and lower rafter sections having centrally depending therefrom a cable receiving finger, said finger having at least two vertically displaced cable receiving slots therein, the associated stabilizing cable being movable from one slot to the other to straighten the associated rafter assembly;

first means for connecting said upper rafter section to said exterior wall;

second means for connecting said lower rafter section to the top of said front wall;

a stabilizing cable interconnected between said first and second connecting means and passing through said slot, the length of said stabilizing cable being such that in its secured condition the rafter assembly of which it is a part is generally straight;

a flexible roof overlying said rafter assemblies; and means for securing said roof in said overlying position.

2. The enclosure as set forth in claim 1 which further includes stabilizing members interconnecting said rafter assemblies for preventing rotation thereof.

3. The enclosure as set forth in claim 2 wherein each of said rafter assemblies includes a hub having oppositely directed rafter tube receiving fingers, said cable receiving finger depending from said hub and wherein said upper and lower rafter sections comprise hollow metallic tubes telescopically engaging said rafter tube receiving fingers.

4. The enclosure as set forth in claim 3 wherein at least some of said hubs also include stabilizing tube receiving fingers extending therefrom at 90° intervals to said rafter tube receiving fingers, said stabilizing members comprising hollow metallic tubes telescopically engaging facing stabilizing tube receiving finger on adjacent hubs.

5. A patio enclosure adapted to be secured adjacent an exterior wall of an existing structure, said enclosure comprising:

a plurality of front panels and side panels, said panels being hingedly secured, one to another, and erectable, to form the sidewalls and front wall of said enclosure;

a plurality of rafter assemblies each extending in downwardly sloped fashion from said exterior wall to the top of the front wall, each of said rafter assemblies including upper and lower rafter sections having centrally depending therefrom a cable receiving finger, said finger having at least one stabilizing cable receiving slot therein;

first means for connecting said upper rafter section to said exterior wall;

second means for connecting said lower rafter section to the top of said front wall;

a stabilizing cable interconnected between said first and second connecting means and passing through said slot, the length of said stabilizing cable being such that in its secured condition the rafter assembly of which it is a part is generally straight;

said first connecting means including a flexible hinge section having undercut therebelow a cable retaining slot accessible through a downwardly facing passageway, downward flexing of said first connecting means thereafter closing said passageway and locking said stabilizing cable in said slot;

a flexible roof overlying said rafter assemblies; and means for securing said roof in said overlying position.

6. A patio enclosure adapted to be secured adjacent an exterior wall of an existing structure, said enclosure comprising:

a plurality of front panels and side panels, said panels being secured, one to another, and erectable, to form the sidewalls and front wall of said enclosure;

a plurality of rafter assemblies each extending in downwardly sloped fashion from said exterior wall to the top of the front wall, each of said rafter assemblies including upper and lower hollow, tubular rafter sections and a hub telescopically interconnecting said upper and lower rafter sections, said hub having oppositely directed rafter tube receiving fingers, a cable receiving finger having at least one stabilizing cable receiving slot depending therefrom, at least some of said hubs also including stabilizing tube receiving fingers extending therefrom at 90° intervals to said rafter tube receiving fingers, said stabilizing tube receiving fingers being offset vertically downwardly from said rafter tube receiving fingers;

first means for connecting said upper rafter section to said exterior wall;

second means for connecting said lower rafter section to the top of said front wall;

a stabilizing cable interconnected between said first and second connecting means and passing through said slot, the length of said stabilizing cable being such that in its secured condition the rafter assembly of which it is a part is generally straight;

hollow, tubular stabilizing members telescopically engaging facing stabilizing tube receiving fingers on adjacent hubs;

a flexible roof overlying said rafter assemblies; and means for securing said roof in said overlying position.

* * * * *